US006220526B1

(12) United States Patent
Johnson

(10) Patent No.: US 6,220,526 B1
(45) Date of Patent: Apr. 24, 2001

(54) METHOD AND DEVICE FOR APPLYING ADHESIVES

(75) Inventor: Jeff Johnson, Dalton, GA (US)

(73) Assignee: Capitol USA, LLC, Dalton, GA (US)

( * ) Notice: Subject to any disclaimer, the term of this patent is extended or adjusted under 35 U.S.C. 154(b) by 0 days.

(21) Appl. No.: 09/399,385

(22) Filed: Sep. 20, 1999

(51) Int. Cl.[7] ..... B05B 11/02

(52) U.S. Cl. ..... 239/323; 239/305; 239/327; 239/146; 222/95

(58) Field of Search ..... 239/304, 305, 239/327, 320–323, 146; 222/95, 105

(56) References Cited

U.S. PATENT DOCUMENTS

| | | | | |
|---|---|---|---|---|
| 3,286,933 | * | 11/1966 | Savage | 239/304 |
| 4,629,094 | * | 12/1986 | Vogel et al. | 222/82 |
| 5,064,123 | * | 11/1991 | Aiello et al. | 239/305 |
| 5,593,091 | * | 1/1997 | Harris | 239/304 |
| 5,788,378 | * | 8/1998 | Thomas | 383/63 |
| 5,868,319 | * | 2/1999 | Gilmore | 239/323 |
| 5,897,061 | * | 4/1999 | Petty | 239/304 |
| 5,976,631 | * | 11/1999 | Ramachandran | 239/526 |

OTHER PUBLICATIONS

Sta—Put, Product Information Sheet for Accessories for Sta Put Products, Revised Feb. 20, 1995, 3 pages.

TACC International Corporation, Brochure for Packaged Adhesives, 3 pages.

X–lent Equipment Company, Brochure for Spray Equipment, A New Concept in Spray Equipment.

Floor Covering Installer, Products, Tools, Accessories, Mar./Apr., 1999, p. 50.

Hedwin Company, Cubitainer Combination Package Brochure, 6 pages.

X–lent Equipment Company, Ultra Air, A New Concept in EIFS Spray Equipment, 2 pages.

Roberts Consolidated Industries, Floor Covering Installation Products, 1996 Edition, pp. 18–20.

* cited by examiner

*Primary Examiner*—David A. Scherbel
*Assistant Examiner*—Dinh Q. Nguyen
(74) *Attorney, Agent, or Firm*—Miller & Martin LLP

(57) ABSTRACT

A method, system and sprayer for applying adhesives, or other coatings, is disclosed herein including a positive displacement pump having an inlet connected through a dispensing nozzle to a reducible volume container. The reducible volume container may be located in a more rigid container such as a cardboard box. As the positive displacement pump is operated, a suction on the collapsible container is drawn by the positive displacement pump. The pump may pump adhesives, or any other fluid material, preferably into an attached hose and through a bayonet type spray wand. The spray wand may have a replaceable tip to alter the spray coverage and may be activated by a trigger.

25 Claims, 3 Drawing Sheets

METHOD AND DEVICE FOR APPLYING ADHESIVES

FIELD OF THE INVENTION

This invention relates to spraying devices, and in particular to a transportable adhesive sprayer system and method of applying adhesive, such as an adhesive utilized to adhere carpet to a floor.

BACKGROUND OF THE INVENTION

In the art of applying adhesives for adhering carpet to a flooring or other material, a number of methods and/or systems have been developed. One method of applying carpet adhesive to a floor is to remove a supply of adhesive from a pail, such as a 5-gallon pail, and spread manually with a trowel or other device. This method of applying adhesive is labor intensive and may involve additional clean-up efforts compared to more automated methods. Furthermore, the adhesive is not in a closed container or system during the application process whereby foreign material could end up in the adhesive mixture by falling in the pail or by being inadvertently introduced by the manual spreaders.

Carpet adhesives normally come in pails, such as 5-gallon pails. One company, Roberts Consolidated Industries, Inc., of California, makes a spray adhesive system which is capable of dispensing adhesives directly from such a pail. The Roberts Spray Adhesive System utilizes a sprayer having an electric motor capable of delivering approximately ½ gallon of adhesive per minute. The pump utilized for that sprayer may be varied in speed to control the flow. The pump has a suction including a suction tube which may be deposited within an open bucket situated on the floor below the pump. The pump discharge goes through a length of hose and a spray gun extension in order to spray the adhesive on the flooring surface. This sprayer system does not provide the capability of preventing contaminants from falling into the open bucket of adhesives. Additionally, the open bucket, when exposed to external atmospheric conditions over a period of time, will likely cause the adhesive to dry and/or cure in the bucket prior to being discharged through the sprayer gun. This may result in skinning in the bucket or clogging of parts of this spraying system. Additionally, significant clean up may be required after using this spraying system. Furthermore, the pail is not an integral part of the spray system so that each time a user desires to move the sprayer, the pail must be picked up and the sprayer moved and the user must be careful not to drip or spill the adhesive from the suction or from the pail. In short, the Roberts System is not a sealed system, is not as easily moved from room to room as desired, and may be messy to operate and clean.

A second type of adhesive spraying system known in the art is represented in a product built by the AAT Company. The AAT adhesive sprayer utilizes an air compressor which pressurizes a tank containing adhesives which are then forced through a nozzle in a sprayer. In general, pressurized systems are less favored for two principal reasons. First, in order to maintain a pressurized system, all of the seals and fittings need to be maintained so that they are capable of having an airtight seal. Secondly, in the event of a component failure, the potential for explosive adhesive release exists. One sprayer embodiment of the AAT variety utilizes an 8-gallon tank for the pressurized container. This pressurized tank becomes a pressure pot when filled with compressed air and adhesive. A small hole is located on top of the pressure pot for filling of the pressure pot with adhesives. This small hole is believed to make the filling of the pressure pot difficult, messy, and subject to spills. Once the adhesive is added to the tank, the tank is then closed and pressurized. During the filling of the container with the adhesive, the adhesives come into contact with the atmosphere and the sprayer device is not a closed system. Debris or other foreign matter may enter into the pressure pot during the filling of the adhesives and some amount of skinning or clogging may occur. Additionally, skinning, curing and clogging may occur within the pressurized pressure pot. Furthermore, this device utilizes a sprayer similar to one which may be found in an self-service car wash station. There is no capability for this sprayer to have its tips switched according to the needs of the user.

The X-lent Equipment Company also markets sprayers which operates similar to the AAT product. One version plugs into an air compressor, while the other version has an air compressor as part of the system. These two products both utilize air in a pressure pot to force adhesive through a hose assembly and then through a sprayer having a nozzle. Essentially the compressor builds up pressure within the pressure pot and then the adhesive is blown out the bottom. This system is not a closed system because the pressure pot must be opened and exposed to the atmosphere for adhesive to be added, presenting curing and contamination issues. The pressurized air within the pressure pot is also believed to present curing and contamination issues. The system also suffers from the disadvantages of pressurized systems.

In the pressure pot systems where the adhesive is then disposed through a hose, the fluid dynamics of the pressure pot and hose are believed to result in a loss of head along the length of the hose. Accordingly, some versions of the X-lent products have maximum hose lengths of 75 feet, and some have a maximum length of 100 feet. With a 5½ horsepower motor attached to an 11 or 13 cubic feet per minute compressor with all X-lent pressure pot types, it is believed that there will be a maximum hose length for effective use.

Another manufacturer of pressurized spraying systems is TACC International Corporation located in Rockland, Md. The TACC Systems utilize a pressurized containers, similar to a propane tank, which has adhesive therein. These aerosol spray cans and cylinders are advertised as being highly portable, requiring no outside air or power support and available in both returnable and disposable cylinders. Although the TACC adhesives spraying systems are completely closed systems as far as the user is concerned, they are not refillable or reusable by the user without first returning the containers to the manufacturer for refilling.

As previously discussed, most carpet adhesives are sold in five gallon pails. One company, the Taylor Company, has previously sold carpet adhesives in a cardboard box. However, within their cardboard box was a baggie containing the adhesive. In order to utilize the adhesive within the baggie, the baggie was pulled up and around the cardboard box and the adhesive was scooped out. In use, the adhesive was exposed to atmospheric curing and contamination. It is not believed that this system was, or is, commercially successful.

Accordingly, a need exists for a closed adhesive spraying system, sprayer and method. Furthermore, a need exists to have an adhesive container system adapted for use in an atmospherically closed environment.

SUMMARY OF THE INVENTION

Accordingly, it is an object of the invention to provide an adhesive spraying system and method with a positive displacement pump having a suction connected to a collapsible polyethylene container containing adhesives.

It is a further object of the invention to provide a portable spraying system.

It is another object of the invention to provide an adhesive spraying system which does not utilize a pressure pot.

It is a further object of the invention to provide an adhesive spraying system and method which prevents foreign matter and debris from contaminating the adhesive.

It is yet another object of the present invention to provide an adhesive spraying system to utilize at least two varieties of adhesives without extensive clean up to transition from one adhesive to another.

Still another object of the invention is the ability to utilize and store the adhesive sprayer system without clean up and then reutilize the sprayer system with minimal effort.

Accordingly, the method, system and sprayer disclosed herein include a positive displacement pump with the inlet connected to a dispensing nozzle of a reducible volume container. The reducible volume container may be located within a more rigid container such as a cardboard box. As the positive displacement pump is operated, a suction on the collapsible container is drawn by the positive displacement pump. The pump pumps the adhesive, or other material, preferably into an attached hose and through a bayonet type spray wand. The spray wand may have replaceable spray tips to alter the spray coverage, and may be activated by a trigger.

Figure 1:
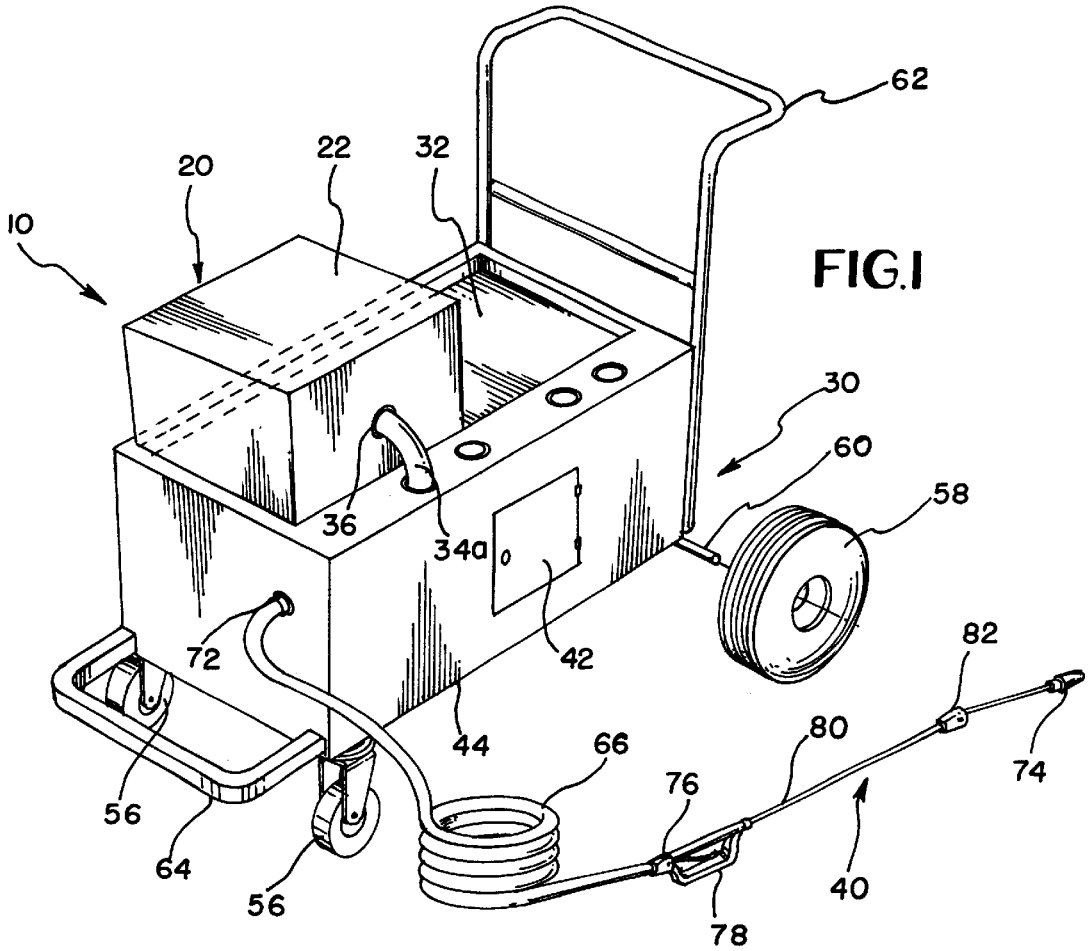
FIG. 1 is perspective view of the preferred embodiment of the spraying system and spraying device according to the present invention with a portion of the top of the sprayer shown in phantom.

Repeat use of reference numerals in the present specification represents like, similar and analogous parts, future drawings of the present invention throughout several views.

DETAILED DESCRIPTION OF THE PREFERRED EMBODIMENT

The present invention is concerned with the application of coatings including adhesives, and more specifically to a method, system and sprayer for applying adhesive, or another material, to a surface. Accordingly, FIG. 1 depicts the adhesive application system 10 including an adhesive container 20, a sprayer 30, and a spray wand 40.

Figure 4A:
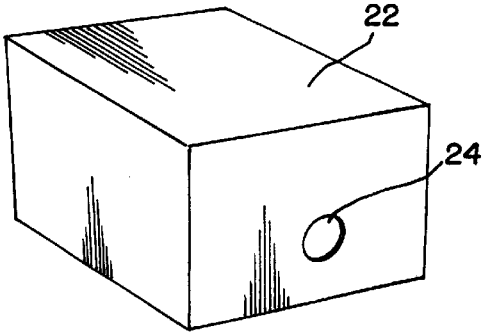
FIG. 4A is perspective view of a cardboard box for housing a flexible container as utilized in the preferred embodiment.
Figure 4B:
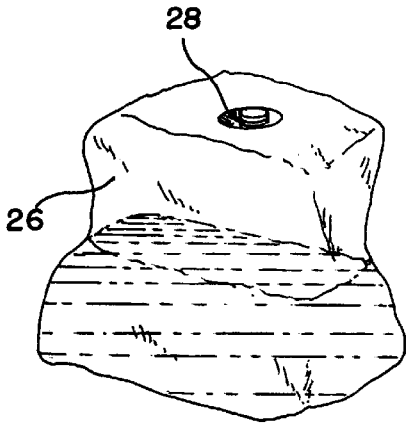
FIG. 4B is a perspective view of a partially filled flexible container utilized with the preferred embodiment.
Figure 4C:
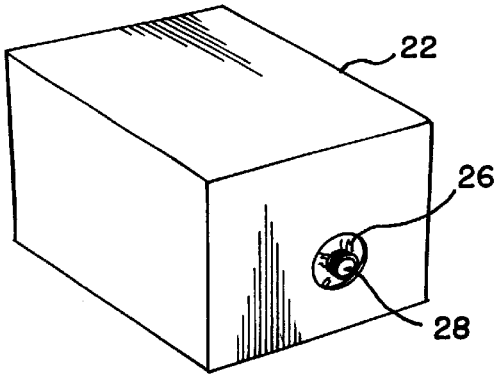
FIG. 4C is a perspective view of the cardboard box of FIG. 4A housing the flexible container of FIG. 4B.

The adhesive container 20 is preferably a collapsible type container. One example of a presently preferred container is the type manufactured by Hedwin Company of Baltimore, Md. This container features a cardboard box 22 shown in FIG. 4A with an opening 24. FIG. 4B is a reducible volume container 26 which fits within the cardboard box 22 as is illustrated in FIG. 4C. The reducible volume container 26 preferably has an opening, illustrated as a dispensing nozzle 28, which may accept a screw on, or other type of cap and connectors. The reducible volume container 26 may be constructed of linear low and low density polyethylene ("LDP") manufactured in the form of a liner for use in the cardboard overpack 22. The polyethylene container is designed to collapse as product is dispensed. The design is intended to allow product to flow from the polyethylene container in a continuous, uninterrupted stream. Alternatively, the reducible volume container 26 may be made of any other deformable material or materials. Additionally, the reducible volume container 26 could be constructed of more rigid materials such as a rigid tube with an end that moves within the tube to reduce the volume as the product is utilized, of the style typically employed with caulking compounds. Nevertheless, the cardboard box 22 with internal reducible volume container 26 has been found effective in storing and stacking the adhesive containers 20. The cardboard box 22 may, or may not, be utilized depending on the particular application desired.

The preferred adhesive container 20 has about a five gallon capacity. Some pressure sensitive adhesives used with this system 10 have had an effective coverage area of approximately thirty or more square yards per gallon. Other adhesives such as vinyl adhesives and/or multipurpose adhesives may also be utilized with this spray system 10. If multiple adhesive containers 20 are stacked on the sprayer 30 and connected to the pump, over 5000 square feet may be covered with adhesive without reloading.

The use of the reducible volume container 26 may allow the user to pump a container 26 dry without losing suction. If a plurality of reducible volume containers 26 are connected together, they may all be pumped from simultaneously. Alternatively, containers may be sequentially selected to be pumped from one at a time.

Figure 5:
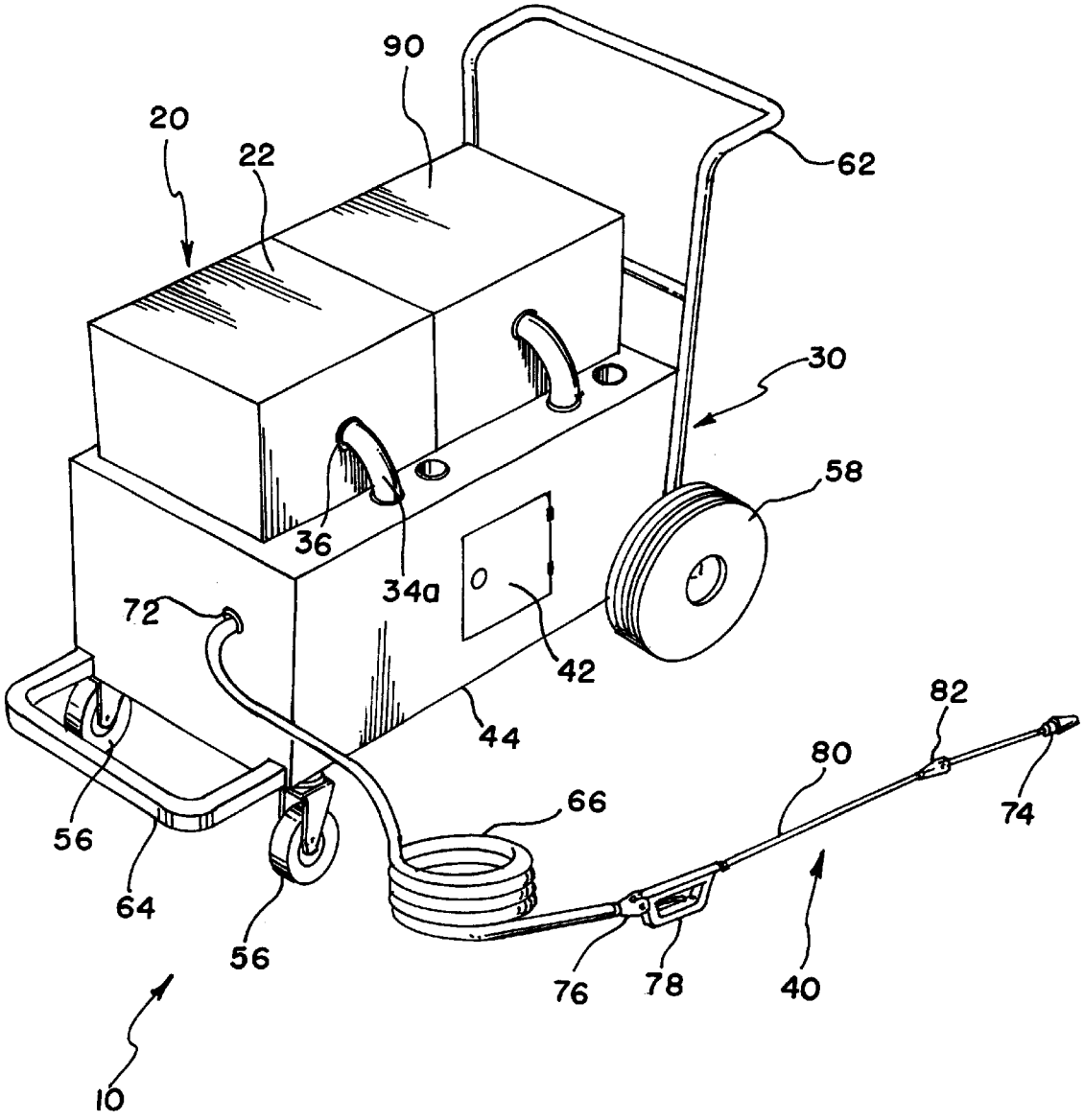
FIG. 5 is a perspective view of the sprayer similar to FIG. 1 with an additional adhesive container attached.

An adhesive container 20 is illustrated atop a portion of the sprayer 30 in FIG. 1. Additionally containers 20 can be stacked alongside and on top of one another on the sprayer 30. If more than one container is utilized, such as containers 20, 90 illustrated in FIG. 5, more than one adhesive type may be dispensed from the plurality of containers 20, 90 without requiring cleaning of the system 10. Although the container is illustrated in FIG. 1 as being at least partially held by recessed portion 32, alternative and/or additional securing mechanisms including cinching belts, bungee cords and the like may be utilized. Alternatively, a user may not find it necessary to securely attach the container 20 to the sprayer 30.

The adhesive container 20 is connected to the sprayer 30 by a supply tube 34. A first end of the supply tube 34 with a connector 36 preferably attaches to the dispensing nozzle 28 of the reducible volume container 26. The use of a T-joint on the first end of the supply tube 34 will permit it to be simultaneously attached to two adhesive containers 20. The second opposed end of the supply tube 34 is preferably connected to the inlet of the pump 38 illustrated in FIG. 2. In order to access the pump and tubing, an access panel 42 may be located on the housing 44. The pump 38 is preferably a positive displacement type pump such as a piston pump spray pump manufactured by Air Lestro Duratech. A suitable pump utilizes a ¾ horsepower DC drive. A rheostat 46 may be utilized to control the pressure at the exit of the pump 38 as is illustrated in FIG. 3.

Figure 2:
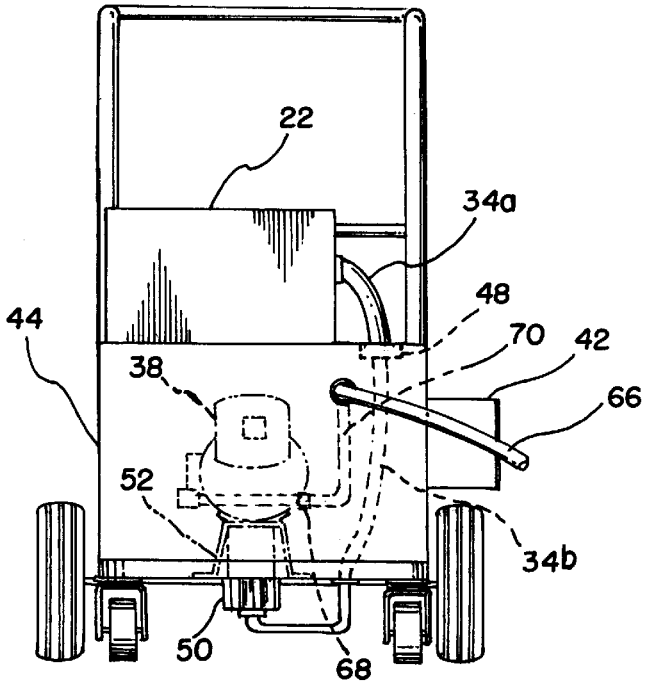
FIG. 2 is a front plan view of the sprayer with the interior shown in phantom.
Figure 3:
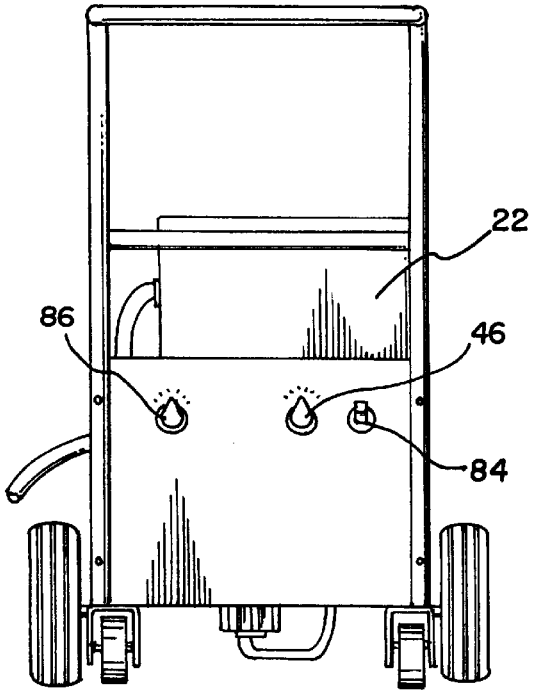
FIG. 3 is a back plan view of the device shown in FIG. 2.

A first portion of the supply tube 34*a* may be connected to a manifold 48, shown in FIG. 2, especially if a plurality of containers 20, 90 are connected to the sprayer 30. The manifold 48 will allow a user to select which of the first tube pertains 34*a* and containers 20, 90 are supplying adhesive through the second tube portion 34*b* to the pump inlet 50. A manifold 48 could allow the use of quick disconnect connections from the supply tubes 34 to the manifold 48. The manifold 48 may include valves and can be utilized to select the particular containers 20, 90.

In a preferred embodiment, the pump 38 utilizes a standard 115 VAC electrical connection and draws approximately six amperes of current. The sprayer 30 may be parked near an electrical outlet and then use the spray hose 66 to conduct adhesive to the locations for application of the adhesives. Alternatively an electrical cable of sufficient length may be utilized to locate the sprayer 30 a significant distance from an electrical outlet. Additionally, the pump 38 may be supplied with electricity from a generator or other source.

The pump 38 is shown mounted within the housing 44 of the sprayer 30. One or more brackets 52 may secure the pump 38 to the housing 44. The housing 44 of the sprayer 30 is mounted on a mobile base as illustrated in FIGS. 1–3 and 5. This hose utilizes four wheels, however other base designs may also be utilized. The two front wheels shown are swivel coasters 56. The two back wheels shown are tires, such as pneumatic tires 58, mounted on axles 60. A mobile base not only facilitates moving the sprayer about the buildings where adhesive is applied, but also in loading and unloading the sprayer on trucks for transportation between jobs.

A handle 62 connected to the mobile base and/or housing 44 is helpful in moving the sprayer 30. A front platform 64 may serve as a bumper and may be utilized to store the spray wand 40 and hose 66 when moving the system 10. The larger rear tires 58 have been found effective to allow users to roll the sprayer 30 on the back wheels like a dolly. Alternatively, the mobile base may be rolled on all four wheels. The housing 44 is preferably a sheet metal or plastic covering over a frame. Additionally, the housing 44 should be narrow enough to fit within most standard doorways.

The pump 38 is located within the housing 44 to minimize its exposure to dust and overspray. An on/off switch 84 may be utilized to turn the pump 38 on and off as shown in FIG. 3. Additionally, the pump 38 may have an optional drive control 86. This configuration for controls 80, 46, 84 has been found effective to minimize the cleanup required after using the system 10. In testing the embodiment illustrated and described herein, the sprayer 30 was operated with a container 20 of adhesives. The sprayer 30 and adhesive container 20 were left attached and stored. Approximately three weeks later, the same container 20 of adhesives was utilized after removing a small amount of adhesive that had settled in the spray tip 74 of the spray wand 40.

The pump outlet 68 is connected to outlet connector tube 70 as shown in FIG. 2. The outlet connector tube 70 connects the pump outlet 68 to the spray hose 66 at outlet connection 72. The connection 72 allows for the removal of the hose 66 and spray wand 40.

The adhesive is preferably pulled by suction from adhesive containers 20 through supply tube 34 into the pump 38 and pumped out tube 70 to connection 72 and through the spray hose 66 to a spray nozzle. The spray hose 66 is preferably connected to a spray wand 40 at a connection, such as swivel connector 76. From the connection, the adhesive enters into the spray wand 40 past trigger switch 78. The trigger switch 78 may allow for controlling the flow of adhesive through the wand 40 or it may be an on/off type controller. From the trigger switch 78, adhesive flows through the wand tube 80 into the spray tip 74. The spray tip 74 may be permanently mounted to the wand tube 80 or may be removable and replaceable. In the removable configuration, a particular spray tip 74 may be selected for a particular application. Spray tips 74 having a 17 mm to 27 mm orifice have been found effective depending on the particular coverage sought by the user of the spray system 10. At least a portion of the spray wand 40, such as bend 82, may be angled in order to direct spray at a particular desired location. The particular spray wand 40 utilized is of the bayonet type, however a pistol grip, other type wands 40 may be utilized.

One preferred method of operation is to place a container 20 having adhesive material within the reducible volume container 26 therein atop the sprayer housing 44. The supply tube 34 is connected to the container 20 and the pump inlet 50. The pump outlet 68 is connected to a hose 66 attached to a spray wand 40. The pump 38 within the sprayer 30 will be turned on and the trigger 78 on the spray wand 40 will direct when and where the adhesive is sprayed. Other methods of operation will incorporate other features of the system 10 taught herein and will be obvious to one skilled in the art.

What is claimed is:

1. A method of applying an adhesive to a surface utilizing a reducible volume container having an interior with a first volume comprising the steps of:

a) connecting a dispensing nozzle of said reducible volume container to an inlet of a pump, said reducible volume container having a supply of an adhesive therein;

b) connecting the outlet of the pump to a spray device;

c) actuating the pump; and d) spraying at least a portion of the adhesive out of the spray device, whereby after spraying said at least a portion of the adhesive from the spray device said reducible volume container having a second volume, said second volume being less than said first volume.

2. The method of claim 1 wherein the spray device further comprises a spray wand, and further comprising the step of activating a trigger on the spray wand to control the spray.

3. The method of claim 1 wherein the pump is a positive displacement pump.

4. The method of claim 1 wherein the reducible volume container is constructed at least in part of a low density polypropylene.

5. The method of claim 1 wherein the reducible volume container is substantially enclosed within a box.

6. The method claim 1 wherein the reducible volume container, the pump and the spray device comprise a substantially closed system.

7. The method of claim 1 wherein the reducible volume container, the pump and the spray wand prevent the adhesive from substantial exposure to atmospheric conditions until the adhesive is sprayed from the spray device.

8. The method of claim 1 wherein a second reducible volume container, is selectively connected to the inlet of the pump.

9. The method of claim 1 wherein the pressure within the reducible volume container is less than or equal to the pressure exterior to the reducible volume container.

10. An adhesive application system comprising:

a first reducible volume container having a dispensing nozzle and an interior with a supply of adhesive therein, said interior of said first reducible volume container in closed and selectable communication through said dispensing nozzle with a spray device, whereby said first reducible volume container selectively communicates with an inlet of a pump, and the spray device communicates with an outlet of the pump.

11. The adhesive application system of claim 10 wherein the pressure within the reducible volume container is less than or equal to the pressure exterior to the first reducible volume container.

12. The coating application system of claim 10 wherein the first reducible volume container is comprised of a collapsible plastic material.

13. The coating application system of claim 12 wherein the first reducible volume container is substantially enclosed within a box.

14. The coating application system of claim 10 wherein the pump is mounted on a mobile base.

15. The coating application system of claim 10 further comprising a manifold intermediate the first reducible volume container and the pump inlet.

16. The coating application system of claim 15 further comprising a second reducible volume container having a supply of coating therein, said second reducible volume container in communication with the manifold through a dispensing nozzle.

17. The coating application system of claim 15 wherein the adhesives in the first and second reducible volume containers are chemically distinct.

18. The coating application of claim 10 wherein the first reducible volume container is in selective communication with the inlet of the pump.

19. The coating application system of claim 10 further comprising a second reducible volume container having a supply of coating therein, said second reducible volume container in selective communication with the inlet of the pump through a dispensing nozzle.

20. The coating application system of claim 19 wherein at least one valve is utilized to achieve the selective communication between the second reducible volume container and the inlet of the pump.

21. A container for adhesives comprising:

a reducible volume container having a supply of adhesive coating therein, said reducible volume container having a dispensing nozzle connectable to a pump, said dispensing nozzle adapted to seal in closed communication with a tube connected to the pump; and an outer box substantially enclosing said reducible volume container.

22. The container for adhesives of claim 21 wherein the reducible volume container is constructed at least in part of a low density polypropylene.

23. The container for adhesives of claim 21 wherein the dispensing nozzle is threaded.

24. The container for adhesives of claim 23 wherein the dispensing nozzle has male threads.

25. The container for adhesives of claim 24 wherein the dispensing nozzle has female threads.

* * * * *

US006220526C1

(12) EX PARTE REEXAMINATION CERTIFICATE (9185th)

United States Patent
Johnson

(10) Number: US 6,220,526 C1
(45) Certificate Issued: Aug. 14, 2012

(54) METHOD AND DEVICE FOR APPLYING ADHESIVES

(75) Inventor: Jeff Johnson, Dalton, GA (US)

(73) Assignee: OMG, Inc., Agawam, MA (US)

Reexamination Request:
No. 90/011,868, Aug. 18, 2011

Reexamination Certificate for:

| | |
|---|---|
| Patent No.: | **6,220,526** |
| Issued: | **Apr. 24, 2001** |
| Appl. No.: | **09/399,385** |
| Filed: | **Sep. 20, 1999** |

(51) Int. Cl.
*B05B 9/04* (2006.01)
*B05B 9/00* (2006.01)

(52) U.S. Cl. ..... 239/323; 239/305; 239/327; 239/146; 222/95

(58) Field of Classification Search ..... None
See application file for complete search history.

(56) References Cited

To view the complete listing of prior art documents cited during the proceeding for Reexamination Control Number 90/011,868, please refer to the USPTO's public Patent Application Information Retrieval (PAIR) system under the Display References tab.

*Primary Examiner*—Robert M. Fetsuga

(57) ABSTRACT

A method, system and sprayer for applying adhesives, or other coatings, is disclosed herein including a positive displacement pump having an inlet connected through a dispensing nozzle to a reducible volume container. The reducible volume container may be located in a more rigid container such as a cardboard box. As the positive displacement pump is operated, a suction on the collapsible container is drawn by the positive displacement pump. The pump may pump adhesives, or any other fluid material, preferably into an attached hose and through a bayonet type spray wand. The spray wand may have a replaceable tip to alter the spray coverage and may be activated by a trigger.

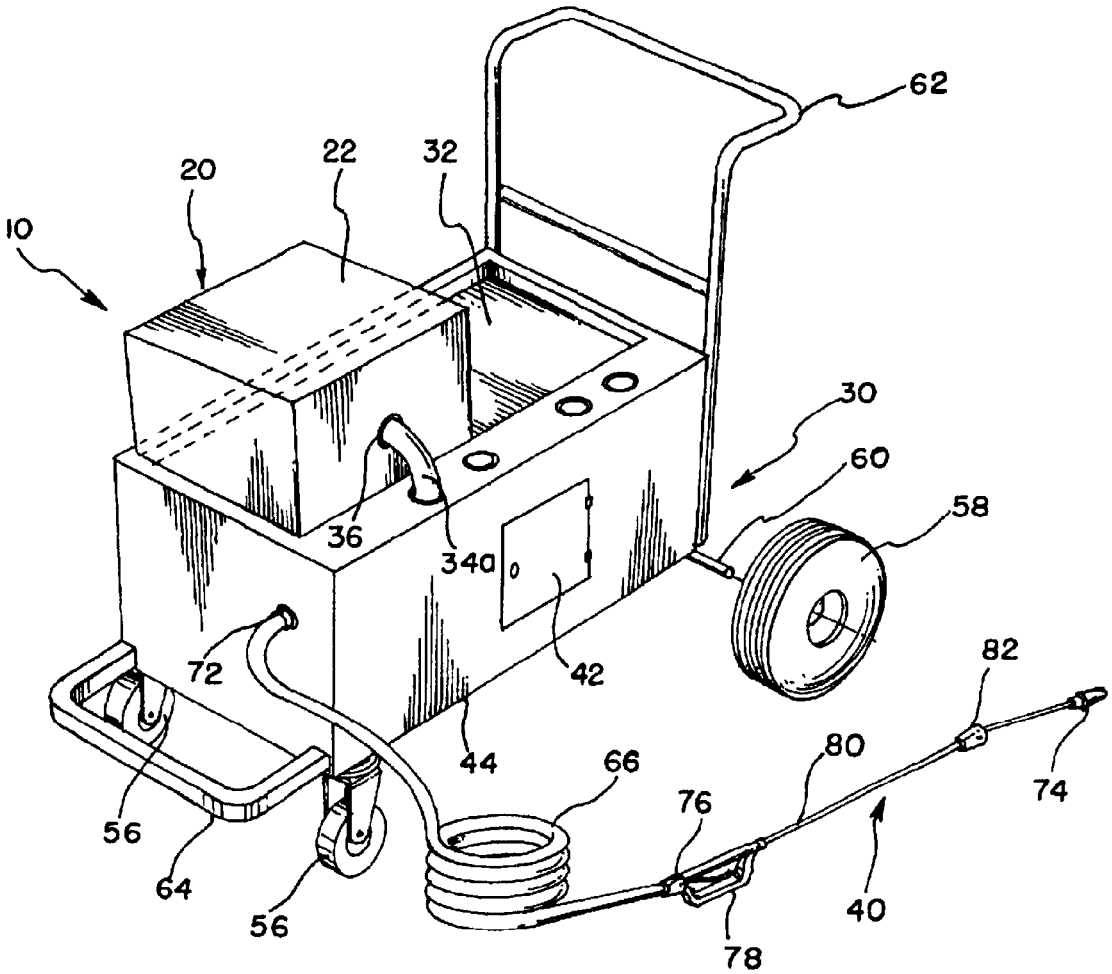

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 21-25 are determined to be patentable as amended.

New claims 26-30 are added and determined to be patentable.

Claims 1-20 were not reexamined.

21. A [container] *device* for *applying* adhesives comprising:

*a pump;*

*a tube connected to the pump;* a reducible volume container having a supply of adhesive coating therein, said reducible volume container having a dispensing nozzle [connectable to a pump], said dispensing nozzle [adapted to seal] *sealed* in closed communication with [a tube connected to the pump] *said tube*; and an outer box substantially enclosing said reducible volume container.

22. The [container for adhesives] *device* of claim 21 wherein the reducible volume container is constructed at least in part of a low density polypropylene.

23. The [container for adhesives] *device* of claim 21 wherein the dispensing nozzle is threaded.

24. The [container for adhesives] *device* of claim 23 wherein the dispensing nozzle has male threads.

25. The [container for adhesives] *device* of claim 24 wherein the dispensing nozzle has female threads.

*26. The device of claim 21 wherein the pump is mounted to a mobile base.*

*27. The device of claim 26 wherein the reducible volume container is supported on the mobile base.*

*28. An adhesive application system comprising:*

*a mobile base;*

*a pump mounted on said mobile base and having an inlet;*

*a reducible volume container having a dispensing nozzle and having a supply of adhesive therein;*

*an outer box substantially enclosing said reducible volume container; and*

*a tube connected to the inlet and sealed in closed communication with said dispensing nozzle.*

*29. The adhesive application system of claim 28 wherein the reducible volume container is supported on the mobile base.*

*30. An adhesive application system comprising:*

*a mobile base;*

*a pump mounted on said mobile base;*

*a reducible volume container having a dispensing nozzle and having a supply of adhesive therein;*

*an outer box substantially enclosing said reducible volume container; and*

*a tube sealed in closed communication with said dispensing nozzle and operatively connected to said pump to supply said adhesive to said pump.*

* * * * *